United States Patent [19]

Murayama et al.

[11] Patent Number: 4,821,331

[45] Date of Patent: Apr. 11, 1989

[54] COAXIAL SPEAKER UNIT

[75] Inventors: Fumio Murayama; Mitsuyoshi Matsuda, both of Yamagata, Japan

[73] Assignee: Pioneer Electronic Corporation, Tokyo, Japan

[21] Appl. No.: 208,534

[22] Filed: Jun. 20, 1988

[30] Foreign Application Priority Data

Jun. 30, 1987 [JP] Japan ..... 62-100764[U]

[51] Int. Cl.[4] ..... H04R 9/06; H04R 1/24; H04R 9/02

[52] U.S. Cl. ..... 381/192; 381/182; 381/188; 381/189

[58] Field of Search ..... 381/182, 186, 188, 189, 381/192, 194–205, 86; 181/199

[56] References Cited

U.S. PATENT DOCUMENTS

| | | | |
|---|---|---|---|
| 2,070,977 | 2/1937 | Quinnell | 381/189 |
| 2,539,672 | 1/1951 | Olson et al. | 381/204 |
| 3,796,839 | 3/1974 | Torn | 381/182 |
| 4,017,694 | 4/1977 | King | 381/194 |
| 4,492,826 | 1/1985 | Chiu | 381/86 |
| 4,552,242 | 12/1985 | Kashiwabara | 381/182 |

FOREIGN PATENT DOCUMENTS

| | | | |
|---|---|---|---|
| 0139186 | 6/1986 | Japan | 181/199 |

*Primary Examiner*—Jin F. Ng
*Assistant Examiner*—David H. Kim
*Attorney, Agent, or Firm*—Sughrue, Mion, Zinn, Macpeak & Seas

[57] ABSTRACT

A coaxial speaker includes a low-frequency band speaker diaphragm which supports, at its inner periphery, a dust-proof member for the speaker core, via a step portion located on the diaphragm at this location. The step portion is planar and generally perpendicular to the speaker bobbin, and may be either a continuous ring or a series of discrete steps arrayed circularly.

5 Claims, 2 Drawing Sheets

COAXIAL SPEAKER UNIT

BACKGROUND OF THE INVENTION

1. Field of the Invention

The present invention generally relates to coaxial speaker units, and particularly relates to a coaxial speaker unit in which dust is prevented from entering a central portion of a low-frequency band magnetic circuit of the coaxial speaker unit.

2. Description of the Prior Art

In most conventional speaker units, as shown in FIG. 4, a mount 9 is provided on a low-frequency band magnetic circuit 1, a high-medium frequency band magnetic circuit 2 is provided on the mount 9, and diaphragms 3 and 4 are provided for the magnetic circuits 1 and 2 respectively, with a gap formed between an upper surface of the low-frequency band diaphragm 3 and a lower surface 2A of the high-medium frequency band magnetic circuit 2. A voice coil 5 is wound on a bobbin 6 of the low-frequency band diaphragm 3. In order to close the above-mentioned gap, a ring 7 is fixed on an upper end surface, in the drawing, of the bobbin 6 and a cylindrical dust-proof member 8 is adhesively fixed between the ring 7 and the lower surface 2A of the low-frequency band magnetic circuit 2.

In the coaxial speaker unit as described above, there has been a problem in that the ring 7 serving as the attachment seat for the dust-proof member 8 must be provided on the bobbin 6 of the voice coil 5, resulting in an increase in assembly costs as well as greater weight of the bobbin 6, thus lowering speaker sensitivity.

SUMMARY OF THE INVENTION

According to the present invention, therefore, in order to make it possible to directly attach a dust-proof member to a low-frequency band diaphragm, a continuous support step portion or separate support step portions are formed on an inner circumferential portion of the low-frequency band diaphragm in a manner so that the support step portion or portions are made planar so as to extend in the radial direction. One end surface of the dust-proof member is brought into contact with the planar surface or surfaces of the support step portion or portions and the dust-proof member is adhesively attached to the latter.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Figure 1:
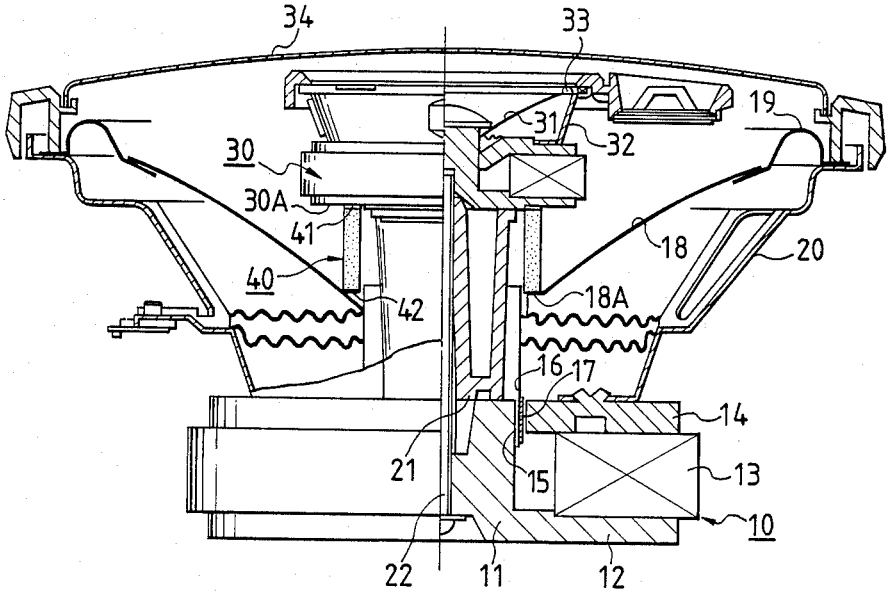
FIG. 1 is a side view in section of the coaxial speaker unit according to the present invention.
Figure 2:
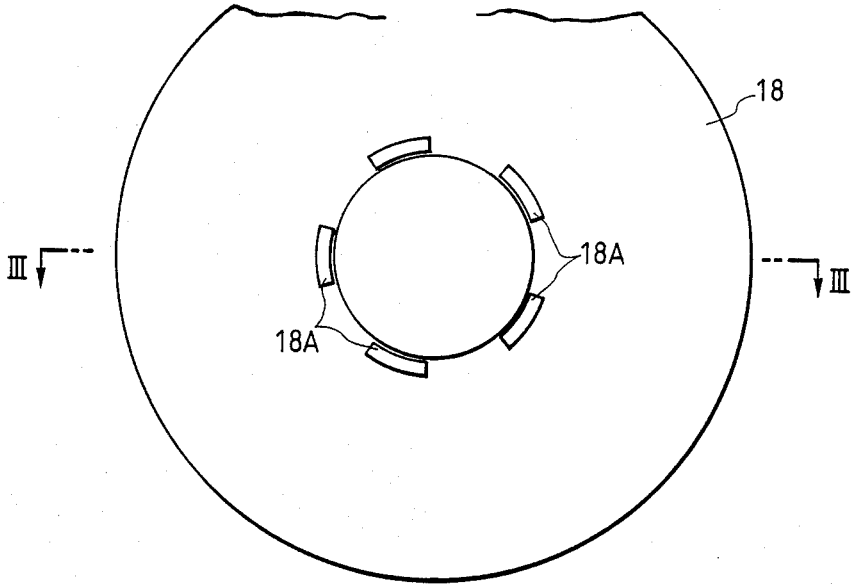
FIG. 2 is a plan view of the low-frequency band diaphragm.
Figure 3:
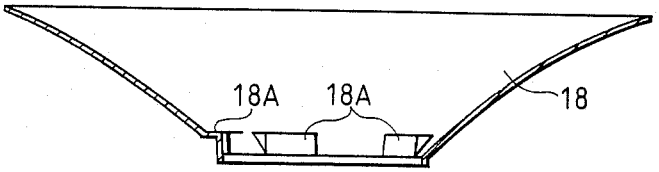
FIG. 3 is a section taken on line III—III in FIG. 2.
Figure 4:
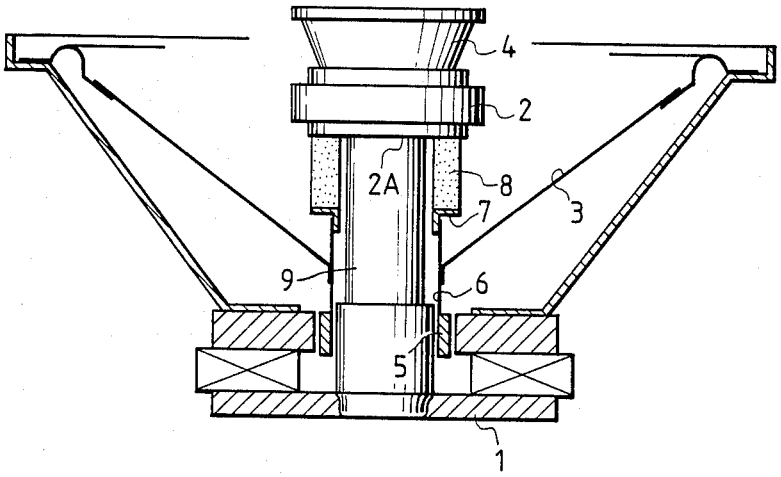
FIG. 4 (PRIOR ART)
FIG. 4 is a partial side view of the conventional coaxial speaker unit.

Referring to FIGS. 1 through 3 of the accompanying drawings, an embodiment of the present invention will be described hereunder. In FIGS. 1 through 3, a low-frequency band magnetic circuit 10 is constituted by a center pole 11, a bottom plate 12 formed integrally with the center pole 11, and a top plate 14 fixed on a magnet 13. A voice coil 17 wound on a bobbin 16 is positioned in an air gap 15 formed between the top plate 14 and the center pole 11, and an inner circumferential edge portion of a low-frequency band diaphragm 18 is fixed on an upper end portion of the bobbin 16. An outer circumferential edge portion of the low-frequency band diaphragm 18 is fixed on a speaker frame 20 through an edge 19.

Further, a hollow mount 21 serving the function of a spacer is fixed on an upper surface of the center pole 11, and a high-medium frequency band magnetic circuit 30 is supported on an upper end of the hollow mount 21 and integrated with the low-frequency band magnetic circuit 10 through a fixing bolt 22 passed through the center pole 11.

The high-medium frequency band magnetic circuit 20 is provided with a high-medium frequency band diaphragm 31. An outer circumferential edge portion of the high-medium frequency band diaphragm 31 is fixed to a speaker frame 32 through edge 33. Front grilles 34 are provided to cover the respective front faces of the low-frequency band and high-medium frequency band diaphragms 18 and 31 respectively.

A cylindrical dust-proof member 40 molded from urethane foam or the like is provided on a bottom surface 30A of the high-medium frequency band magnetic circuit 30 in a manner so as to surround the mount 21. The dust-proof member 40 is in contact, at its one end portion 41, with the bottom surface 30A of the high-medium frequency band magnetic circuit 30, and is adhesively fixed, at its other end portion 42 opposite the end portion 41, on an upper surface of a support step 18A formed so as to project inwardly along the inner circumferential edge of the conical low-frequency band diaphragm 18.

The support step 18A is planar so as to extend in a radial direction of the low-frequency band diaphragm 18 and is parallel to the bottom surface 30A of the high-medium frequency band magnetic circuit 30. The support step 18A may be of a one-piece design, formed continuously in a circular form concentric with the diaphragm 18, or may be composed of a plurality of divided support step portions 18A provided on the concentric circle as shown in FIG. 3.

Accordingly, sufficient contact area can be obtained between the end surface of the dust-proof member 40 and the low-frequency band diaphragm 18, and it is possible to obtain sufficient adhesive strength by applying an adhesive agent to the support step or step portions 18A.

As will be apparent from the foregoing description, according to the coaxial speaker unit according to the present invention, since a continuous step portion or a plurality of divisional step portions are concentrically formed at a center portion of a low-frequency band diaphragm so as to be in parallel with the bottom surface of the high-medium frequency band magnetic circuit, it is possible to obtain a sufficiently large contact area and hence sufficient adhesive strength between the dust-proof member and the support portion or portions.

What is claimed is:

1. A coaxial speaker unit comprising:

a low-frequency band magnetic circuit;

a high-medium frequency band magnetic circuit attached at a central portion of said low-frequency band magnetic circuit through a mount;

a low-frequency band diaphragm driven by said low-frequency band magnetic circuit;

support step means formed along a portion of said low-frequency band diaphragm, said step means being planar and extending in a radial direction of said low-frequency band diaphragm; and a dust-proof member fixed between said support step means and a bottom surface of said high-medium frequency band magnetic circuit.

2. A speaker as claimed in claim 1, wherein said step means comprises a continuous circular step positioned at an inner circumferential location of said diaphragm.

3. A speaker as claimed in claim 1, wherein said step means comprises a plurality of discrete step portions, circularly arrayed, and positioned at an inner circumferential location of said diaphragm.

4. A speaker as claimed in claim 1, wherein said dust-proof member is adhesively secured to said step means.

5. A speaker as claimed in claim 1, further comprising a bobbin surrounding said mount, and being connected to an inner peripheral surface of said diaphragm, said step means being located adjacent said inner peripheral surface and proximate said bobbin, and having a mounting surface for said dust-proof member which is substantially perpendicular to said bobbin.

* * * * *